US008061525B2

(12) United States Patent
Moore

(10) Patent No.: US 8,061,525 B2
(45) Date of Patent: Nov. 22, 2011

(54) PROTECTIVE ELEMENT

(75) Inventor: Kevin Moore, Lexington, KY (US)

(73) Assignee: Metso Minerals (Wear Protection) AB, Trelleborg (SE)

( * ) Notice: Subject to any disclaimer, the term of this patent is extended or adjusted under 35 U.S.C. 154(b) by 254 days.

(21) Appl. No.: 12/268,764

(22) Filed: Nov. 11, 2008

(65) Prior Publication Data

US 2010/0116386 A1 May 13, 2010

(51) Int. Cl.
*B07B 1/46* (2006.01)

(52) U.S. Cl. ..... 209/405; 150/154

(58) Field of Classification Search ..... 209/392, 209/393, 395, 397, 399, 405, 931; 150/154
See application file for complete search history.

(56) References Cited

U.S. PATENT DOCUMENTS 1,718,385 A * 6/1929 Sherwood ..... 209/397
3,664,503 A * 5/1972 Felden ..... 209/397
3,833,120 A * 9/1974 Ogata ..... 209/399
3,905,897 A * 9/1975 Jacobson ..... 209/405
5,398,817 A * 3/1995 Connolly et al. ..... 209/399
6,006,923 A * 12/1999 Helmy et al. ..... 209/397
7,296,685 B2 * 11/2007 Malmberg ..... 209/405
7,303,079 B2 * 12/2007 Reid-Robertson et al. ... 209/405
7,770,737 B2 * 8/2010 Fennekotter et al. ..... 209/405
7,959,009 B2 * 6/2011 Weaver et al. ..... 209/413
2008/0067113 A1 * 3/2008 Helmy ..... 209/405
2008/0169224 A1 * 7/2008 Fennekotter et al. ..... 209/405
2009/0071879 A1 * 3/2009 Helmy ..... 209/412

* cited by examiner

*Primary Examiner* — Joseph C Rodriguez
(74) *Attorney, Agent, or Firm* — Kinney & Lange, P.A.

(57) ABSTRACT

A protective element for a cross member or shaft housing of a frame in a screening arrangement. The protective element is attachable to the cross member or shaft housing by wrapping the protective element around the cross member or shaft housing and clamping a first portion of the protective element to a second portion of the protective element by at least one clamping device. The protective element has an outwards facing surface, which is wear-resistant to withstand wear from piece goods or particle goods impinging or sliding on the outwards facing surface.

21 Claims, 2 Drawing Sheets

PROTECTIVE ELEMENT

FIELD OF THE INVENTION

The present invention relates to a protective element for a cross member or shaft housing of a frame in a screening arrangement. The protective element is attachable to the cross member or shaft housing by wrapping the protective element around the cross member or shaft housing and clamping a first portion of the protective element to a second portion of the protective element by at least one clamping device. The protective element has an outwards facing surface, which is wear-resistant to withstand wear from piece goods or particle goods, such as crushed ore, crushed rock, sand or gravel, impinging or sliding on the outwards facing surface. The invention also relates to a protection for a cross member or shaft housing and a screening arrangement including at least one protective element.

BACKGROUND ART

Various screening arrangements are widely used in the industry in order to control fraction sizes of piece, particle or bulk material. In general, a screening arrangement has one or several screening decks. A screening deck is generally formed of screening elements and a support frame jointly. Each screening element has a plurality of apertures, through which apertures bulk material, such as crushed ore, crushed rock, sand or gravel, is falling in order to be separated from larger pieces of bulk material which cannot fit through the apertures. The screening arrangement generally has a drive apparatus having drive shafts for agitating or shaking the screening deck.

A general problem experienced in screening arrangements is that the parts of the screening arrangement that are exposed to bulk material are subjected to extensive wear. It is therefore well known to make screening elements more resistant to wear by manufacturing the elements from a resilient material. It is however a problem that several parts must be manufactured from rigid material in order to withstand the mechanical stresses they are exposed to. These rigid parts are then more sensitive to wear than the resilient parts, meaning that the rigid parts must be exchanged more frequently or made over-dimensioned in order to withstand the extensive wear.

A particular problem experienced in screening is when bulk material is falling through the apertures of the screening elements and hits rigid parts of the support frame situated below the screening elements. These rigid parts of the support frame are then subjected to extensive wear.

SUMMARY OF THE INVENTION

It is an object of the present invention to provide an improvement of the above prior art.

A particular object is to provide a protective element that protects a cross member or shaft housing of a frame in a screening arrangement from extensive wear.

These and other objects as well as advantages that will be apparent from the following description of the present invention are achieved by a protective element and a protection consisting of several protective elements. Preferred embodiments are defined in the dependent claims.

Hence, a protective element for a cross member or shaft housing of a frame in a screening arrangement is provided. The protective element is attachable to the cross member or shaft housing by wrapping the protective element around the cross member or shaft housing and clamping a first portion of the protective element to a second portion of the protective element by at least one clamping device. The protective element has an outwards facing surface, which is wear-resistant to withstand wear from piece goods or particle goods impinging or sliding on the surface.

The protective element is advantageous in that it provides a cost effective and efficient protection against wear for a cross member or shaft housing of a frame in a screening arrangement.

The protective element may exhibit a tight fit around the cross member or shaft housing, which results in that no goods can work its way in between the protective element and the cross member or shaft housing and thus wear down the cross member or shaft housing.

The protective element may include at least one clamping device for clamping the protective element to at least one other protective element. This means that it is possible to assemble a protection comprising a plurality of protective elements.

The protective element may comprise elastomeric material, which is advantageous in that the element is flexible and exhibits a high wear resistance, when exposed to piece goods or particle goods.

The protective element may include at least one material from the group consisting of: elastomeric materials, ceramic materials, mineral materials and metal materials. This means that it is possible to adapt the characteristics of the protective element for the application in question.

The protective element may include at least two elastomeric materials with different hardness, which is advantageous in that different portions of the protective element can exhibit different hardness.

The protective element may comprise polyurethane, which results in that the protective element exhibits a high wear resistance.

The protective element may comprise rubber, which also results in that the protective element exhibits a high wear resistance.

The protective element may further comprise reinforcement material, which is advantageous in that the protective element can be adapted to withstand higher wear and mechanical stresses.

The outward facing surface of the protective element may be provided with at least one wear resistant body, which results in that the surface of the wear resistant element exhibits a high wear resistance.

The wear resistant body may include at least one material chosen from the group consisting of: elastomeric materials, ceramic materials, mineral materials and metal materials. This is advantageous in that it is possible to adapt the characteristics of the wear resistant body to the application in question.

The at least one clamping device may include at least one projection, which is advantageous in that the projection may be used to clamp the protective element to the cross member or shaft housing and/or at least one other protective element in a simple and secure way.

In some embodiments the at least one projection may have a semicircular shape and an undercut so that it has a cross sectional radius that increases with increased distance when moving outwards normal to said outward facing surface. This means in other words that the cross section of the projection may increase either continuously or discrete, to any suitable degree, for example giving a conical, frustoconical or stepped profile of the projection. This is advantageous in that two projections can be clamped together using a clamping ring without risking that the clamping ring slips off the two projections.

The at least one clamping device of the protective element may include at least one hole, which can advantageously be used to secure the protective element to the cross member or shaft housing and/or to another protective element.

The at least one clamping device of the protective element may include at least one projection and at least one hole, which is advantageous in that the protective element can be secured to the cross member or shaft housing and/or another protective element without using any additional clamping devices.

In another embodiment the at least one clamping device may include at least one additional clamping device. This is a simple and cost effective way of securing the protective elements to the cross member or shaft housing and/or to each other, since the protective elements can be made simple without complex clamping devices.

In another embodiment the at least one additional clamping device may include at least one clamp ring, which is advantageous in that the clamp ring can be applied without using any tools.

In yet another embodiment the at least one clamp ring may be an elastic O-ring, which is advantageous in that the O-ring exerts a compressive force once clasping the clamping devices.

The at least one additional clamping device may include at least one pin or bolt, meaning that the protective elements can be secured to the cross member or shaft housing and/or another protective element in a secure, simple and cost effective manner.

In yet another embodiment the outward facing surface of the protective element may advantageously be provided with at least one ridge. This implies that piece or particle goods will more easily fall off the outward facing surface and will thus not start to accumulate on the surface.

A plurality of protective elements may form a wear protection for a cross member or shaft housing of a frame in a screening arrangement. The wear protection thus provides good protection from wear to the cross member or shaft housing of the frame.

A screening arrangement may include at least one protective element, which is advantageous in that the screening arrangement will become more resistant to wear and thus last longer before it must be replaced.

BRIEF DESCRIPTION OF THE DRAWINGS

The invention will in the following be described by way of example based on one embodiment and with reference to the accompanying schematic drawings, in which.

DESCRIPTION OF PREFERRED EMBODIMENTS

Figure 1:
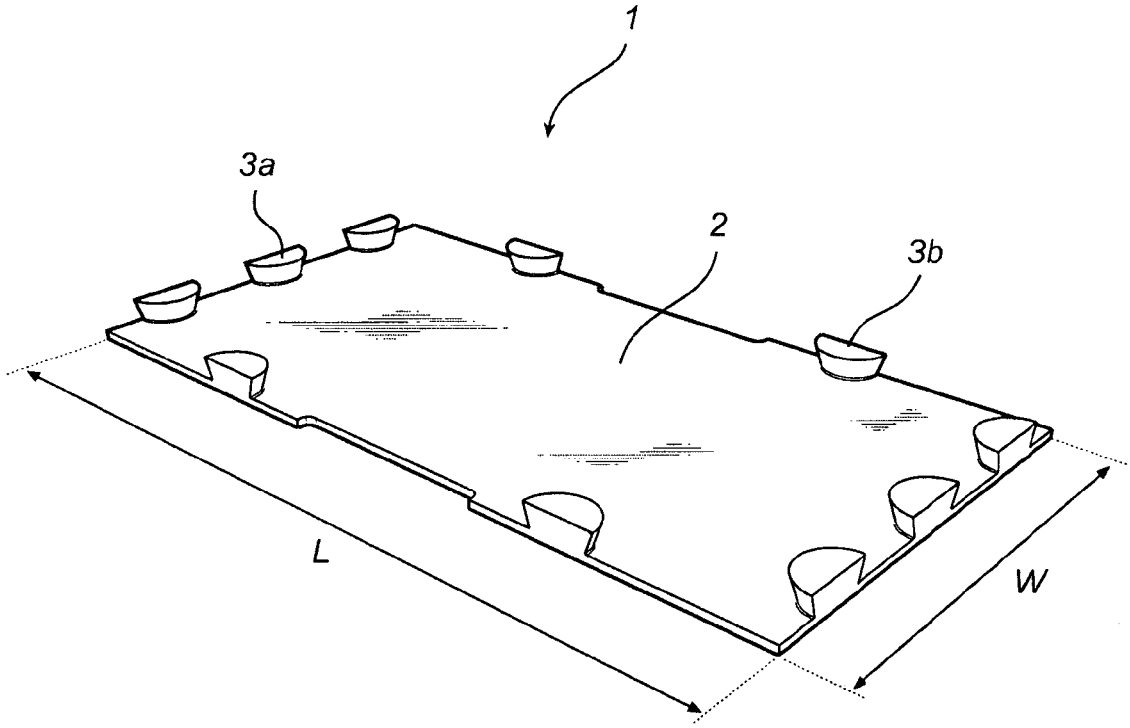
FIG. 1 is a perspective view of a protective element.

A protective element 1 is shown in FIG. 1. The protective element 1 is moulded from polyurethane, with a hardness of 60 Shore A. The body portion 2 of the protective element 1 has a thickness of 6 mm. Further, the protective element 1 is supplied with a number of projections 3*a*, 3*b*. The projections 3*a*, 3*b* are moulded from the same material and are integral with the body portion 2. The projections 3*a*, 3*b* are semicircular and have a tapered profile, meaning that the cross sectional radius of the projections 3*a*, 3*b* increases with increased distance from the body portion 2.

Figure 2:
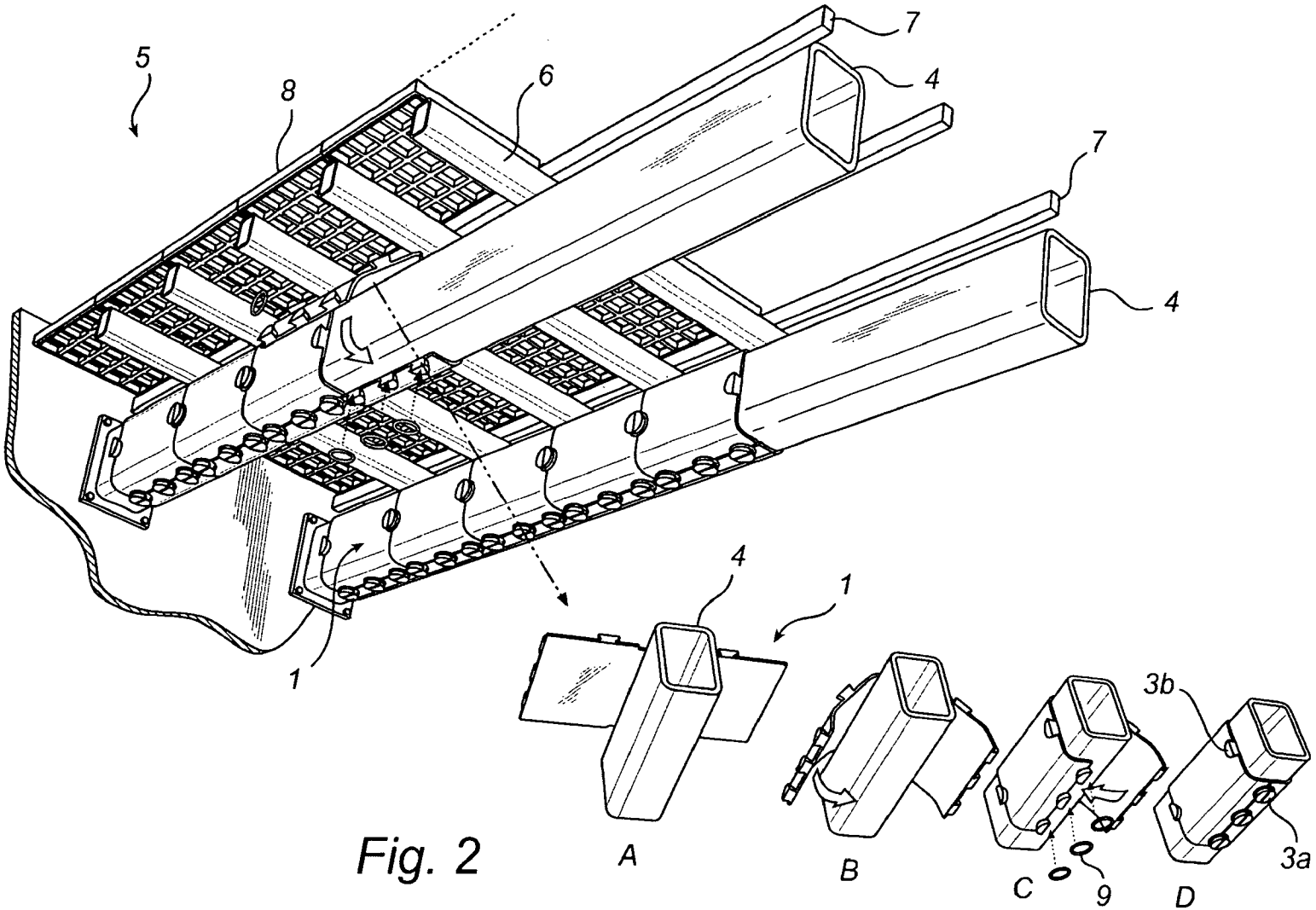
FIG. 2 is a perspective partial view of a screening arrangement including a plurality of protective elements.

FIG. 2 illustrates schematically how a number of protective elements 1 are wrapped around two different cross members 4 of a frame in a screening arrangement 5, partially shown. The screening arrangement 5 includes a frame consisting of the lower cross members 4 and the upper cross members 6. The lower cross members 4 and the upper cross members 6 are orientated perpendicular to each other. On top of the upper cross members 6 there are a number of support members 7 arranged perpendicular to the upper cross members 6. A number of screening elements 8 are then located on top of the support members 7, and attached in any suitable manner.

When the screening arrangement 5 is operated, piece goods or particle goods, falls through the apertures of the screening elements 8 and impinge or slide on the outer surface of the lower cross members 4. The falling goods will then start to wear down the cross members 4, unless covered by protective elements 1.

The protective element 1 is soft and flexible, and can thus be wrapped around the cross member 4 easily. Since the protective element 1 is soft and flexible it is possible to wrap it around cross members 4 with different cross sections. In other words, the protective element 1 is not only suitable for cross members 4 with rectangular cross sections as shown in FIG. 2, but also for example for cross members 4 with circular or square cross sections.

When the protective element 1 is manufactured, the length L of the protective element 1 is adapted to correspond to the circumference of the cross member 4. It is important to adapt the length L of the protective element 1 to make it fit tightly around the cross member 4. By doing this adaptation, piece goods or particle goodscan be prevented from working its way in between the protective element 1 and the cross member 4. This means that no wear will occur on the cross member 4 itself.

The width W of the protective element 1 is adapted to fit a particular portion of the cross member 4. The cross member 4 is in practice covered by a number of protective elements 1, which all together exhibits a width equal to the length of the cross member 4.

In order to be able to fasten the protective element 1 to the cross member 4, the protective element 1 is provided with projections 3*a*, 3*b*. The protective element 1 in FIG. 1 is provided with three projections 3*a* along each of the two sides defining the width W of the protective element 1. Further, the protective element 1 in FIG. 1 is provided with two projections 3*b* along each of the two sides defining the length L of the protective element 1.

When wrapping around and securing the protective element 1 to the cross member 4, the first step A in FIG. 2, is to place the protective element 1 on top of the cross member 4. The second step B, is to bend and wrap the protective element 1 around the cross member 4. In the third step C, elastic O-rings 9 are used to clasp any pair of the semi circular projections 3*a* meeting and coming into contact with each other. In the fourth step D, the protective element 1 is secured to the cross member 4 by the O-rings 9 clasping the projections 3*a*.

The protective element 1 is then secured to its neighbouring protective element/elements 1. This is done by letting an elastic O-ring 9 clasp one semicircular projection 3*b* from the protective element 1 itself and one semicircular projection 3*b* from one of the neighbouring protective element/elements 1, at each location where a pair of projections 3*b* from two different protective elements 1 meet and contact each other.

The O-rings 9 will exert a compressive force on any pair of clasped projections 3*a*, 3*b*, meaning that the projections 3*a*, 3*b* will be pulled together. In the case with a pair of projections 3*a*, along the width W of the protective element 1, the O-rings 9 will pull the projections 3*a* together, resulting in that the protective element 1 will exhibit a compressive force on the cross member 4, resulting in a tight fit. In the case with the projections 3*b*, along the length L of the protective element 1, the O-ring 9 will pull the projections 3*b* together, resulting in that the protective element 1 will be secured tightly to its neighbouring protective element/elements 1.

The use of elastic O-rings 9 results in that no tools need to be used when the protective element 1 is mounted on the cross member 4 of the screening arrangement 5. The O-rings 9 can simply be pulled by hand to clasp any pair of the projections 3*a*, 3*b*.

As shown in FIG. 2, a plurality of protective elements 1 are assembled to form a protection covering one or several cross members 4 of the screening arrangement 5.

A person skilled in the art will realise that a large number of modifications of the here described embodiment of the invention are conceivable within the scope of the invention, which is defined in the appended claims.

For instance, the material used in the protective element can be varied in order to suit the usage of the screening arrangement 5. For example, natural or synthetic rubber can be used as well as any other suitable elastomeric material.

It is, for example, also possible to use various other materials, such as ceramic materials, mineral materials and metal materials, in the protective element 1, in order to adapt the characteristics of the protective element 1.

For example, the hardness of the material used in the protective element 1 may be varied depending on how the screening arrangement 5 is to be used. The hardness of the material is however preferably in the range of 10-80 Shore A, more preferably in the range from 30-60 Shore A and most preferably about 60 Shore A.

For instance, different elastomeric materials with different hardness can be used in the protective element 1 in order to adapt the characteristics of the protective element 1. By doing this, it is also possible to make portions of the protective element 1 that are subjected to more extensive wear in a more durable material.

Another approach that, for example, also can be used to make the protective element 1 more durable is to include reinforcement material into the protective element 1.

Yet another approach that, for example, can be used in order to make the protective element 1 more durable is to provide the outward facing surface of the protective element 1 with wear resistant bodies made of, for example, elastomeric materials, ceramic materials, mineral materials or metal materials.

The protective element 1 can, for example, be made of rigid material, but would in this case have to be moulded in the shape of the cross member 4 or include a hinge portion to allow the desired fit around the cross member 4.

Also, the thickness of the material used in the protective element 1 can be varied depending on how the screening arrangement 5 is to be used. The thickness of the element is preferably in the range of 2-30 mm, more preferably in the range of 4-8 mm and most preferably about 6 mm.

The projections 3*a*, 3*b* of the protective element 1 can, for example, be made separately and then attached to the body portion 2 by high strength glue or a screw, bolt, nail or rivet device. In this case, it is possible to form the body portion 2 of the protective element 1 from a flat sheet of elastomeric material.

The projections 3*a*, 3*b* can, for example, be formed as blocks with a hole. A screw, bolt, pin or other mechanical fastener can then be used to pull any pair of the projections 3*a*, 3*b* together.

Also, the shape of the projections 3*a*, 3*b* can be modified to any shape suitable for clamping the protective element 1 around the cross member 4 and/or to the neighbouring protective element/elements 1.

The number of projections 3*a*, 3*b* may of course be altered in order to suit the actual size of the protective element 1, i.e. the size of the cross member 4 on which the protective element 1 is to be installed.

The projections 3*b* located along the sides of the protective element 1 can, for example, be excluded, meaning that the protective element 1 will only be secured due to the fact that it is wrapped tightly around the cross member 4.

Another approach that, for example, can be used is to provide the protective element 1 with projections 3*a*, 3*b* as well as holes. The projections 3*a* along one of the sides defining the width W can then be replaced with holes, adapted to receive the projections 3*a* remaining on the other side that defines the width W. Analogously, the projections 3*b* along one of the sides defining the length L can be replaced with holes, adapted to receive similar projections 3*b* located on a neighbouring protective element 1. By doing this, it is possible to secure the protective element 1 to the cross member 4 by fitting the projections 3*a* through the holes. In the same way, it is possible to secure the protective element 1 to the neighbouring protective element/elements 1 by fitting the projections 3*b* through the holes.

For instance, the elastic O-rings 9 can be replaced with any kind of rigid rings, like metal rings or rings made of rigid synthetic material.

The protective element 1 can, for example, be provided with one or several ridges on the outwards facing surface, depending on the goods to be screened. In this case, it is advantageous to provide at least one ridge on the portion of the outwards facing surface of the protective element 1 that is supposed to be facing upwards towards the apertures of the screening elements 8. By doing this, goods impinging or sliding on the upwards facing portion of the outwards facing surface of the protective element 1 will fall off more easily, and will thus not start to accumulate on the surface.

It is, for example, possible to glue the protective element 1 to the cross member 4. By doing this it is not necessary to adapt the length of the protective element 1 to correspond the circumference of the cross member 4, since no goods can work its way in between the protective element 1 and the cross member 4. It is also possible to fill a void space between the protective element 1 and the cross member 4 with caulking compound to prevent goods from working its way in between the protective element 1 and the cross member 4. It is also possible to seal the joints between different portions of the protective element 1 or the joints between two neighbouring protective elements 1 by caulking compound. By doing this, goods will be prevented from working its way in between the protective element 1 and the cross member 4.

The present invention can, of course, be used to protect various parts of the frame in a screening arrangement 5, as well as other parts of the screening arrangement 5. A shaft housing used for the operation or agitation of the frame in the screening arrangement can also advantageously be protected by the protective element 1.

The protective element 1 can also be used in screening arrangements 5 that lacks the support members 7. In this case the screening elements 8 are located on top of the upper cross members 6.

It is, for example, also possible to fit the protective element 1 around the upper cross members 6 in order to protect these. In this case, only the size of the protective element 1 needs to be adapted to make it fit the upper cross members 6.

For instance, the width W of a protective element 1 can be adapted to fit the entire length of a cross member 4. By doing this, only one single protective element 1 is needed per cross member 4. A person skilled in the art will, of course, also understand that it is possible to fit as many protective elements 1, along the length of a cross member 4, as he pleases.

For example, it is possible to adapt the outer surface of the protective element 1 to make it suit wet applications, as well as dry applications, i.e. wet or dry screening.

The invention claimed is:

1. A protective element for a cross member or shaft housing of a frame in a screening arrangement, comprising:

a body portion that is attachable to said cross member or shaft housing by wrapping said body portion around said cross member or shaft housing and clamping a first portion of said body portion to a second portion of said body portion by a first clamping device, wherein said body portion has an outwards facing surface, which is wear-resistant to withstand wear from piece goods or particle goods impinging or sliding on said surface;

and wherein said body portion includes a second clamping device for clamping said body portion to at least one other protective element.

2. The protective element according to claim 1, wherein said body portion exhibits a tight fit around said cross member or shaft housing.

3. The protective element according to claim 1, wherein said protective element comprises elastomeric material.

4. The protective element according to claim 1, wherein said protective element includes at least one material from the group consisting of:

elastomeric materials, ceramic materials, mineral materials and metal materials.

5. The protective element according to claim 1, wherein said protective element includes at least two elastomeric materials with different hardness.

6. The protective element according to claim 1, wherein said protective element comprises polyurethane.

7. The protective element according to claim 1, wherein said protective element comprises rubber.

8. The protective element according to claim 5, wherein said protective element further comprises reinforcement material.

9. The protective element according to claim 1, wherein said outward facing surface of said body portion is provided with at least one wear resistant body.

10. The protective according to claim 9, wherein said at least one wear resistant body includes at least one material chosen from the group consisting of:

elastomeric materials, ceramic materials, mineral materials and metal materials.

11. The protective element according to claim 1, wherein said first clamping device includes at least one projection.

12. The protective element according to claim 11, wherein said at least one projection has a semicircular shape and an undercut so that it has a cross sectional radius that increases with increased distance when moving outwards normal to said outward facing surface.

13. The protective element according to claim 1, wherein said first clamping device includes at least one hole.

14. The protective element according to claim 1, wherein said first clamping device includes at least one projection and at least one hole.

15. The protective element according to claim 1, wherein said first clamping device includes at least one additional clamping device.

16. The protective element according to claim 15, wherein said at least one additional clamping device includes at least one clamp ring.

17. The protective element according to claim 16, wherein said at least one clamp ring is an elastic O-ring.

18. The protective element according to claim 15, wherein said at least one additional clamping device includes at least one pin or bolt.

19. The protective element according to claim 1, wherein said outward facing surface of said body portion is provided with at least one ridge.

20. A protection for a cross member or shaft housing of a frame in a screening arrangement, wherein said protection is attachable to said cross member or shaft housing by wrapping said protection around said cross member or shaft housing and clamping a first portion of said protection to a second portion of said protection by at least one clamping device, and wherein said protection has an outwards facing surface, which is wear-resistant to withstand wear from piece goods or particle goods impinging or sliding on said surface, wherein said protection consists of a plurality of protective elements comprising:

a body portion that is attachable to said cross member or shaft housing by wrapping said body portion around said cross member or shaft housing and clamping a first portion of said body portion to a second portion of said protective element by a first clamping device, wherein said body portion has an outwards facing surface, which is wear-resistant to withstand wear from piece goods or particle goods impinging or sliding on said surface;

and wherein said body portion includes a second clamping device for clamping said body portion to at least one other protective element.

21. A screening arrangement including at least one protective element comprising:

a body portion that is attachable to said cross member or shaft housing by wrapping said body portion around said cross member or shaft housing and clamping a first portion of said body portion to a second portion of said protective element by a first clamping device, wherein said body portion has an outwards facing surface, which is wear-resistant to withstand wear from piece goods or particle goods impinging or sliding on said surface;

and wherein said body portion includes a second clamping device for clamping said body portion to at least one other protective element.

* * * * *